US005584471A

United States Patent [19]

Muck et al.

[11] Patent Number: 5,584,471

[45] Date of Patent: Dec. 17, 1996

[54] REPRODUCTION MACHINE HAVING A USER CLEARABLE CONVENIENCE STAPLER ASSEMBLY

[75] Inventors: Dennis N. Muck, Rochester; Stefan A. Jasinski; Frank A. Grossi, both of Webster, all of N.Y.

[73] Assignee: Xerox Corporation, Stamford, Conn.

[21] Appl. No.: 549,354

[22] Filed: Oct. 27, 1995

[51] Int. Cl.[6] ..... B25C 5/02; B42C 1/12

[52] U.S. Cl. ..... 270/52.18; 270/58.08; 277/123; 277/131

[58] Field of Search ..... 270/58.08, 58.14, 270/52.18; 227/120, 123, 131

[56] References Cited

U.S. PATENT DOCUMENTS

| | | | |
|---|---|---|---|
| 2,117,743 | 5/1938 | Polzer | 227/123 X |
| 2,556,992 | 6/1951 | Wandel | 227/123 |
| 4,496,091 | 1/1985 | Yasuda | 227/123 |
| 5,094,379 | 3/1992 | Hoyer et al. | 227/2 |
| 5,106,066 | 4/1992 | Shea et al. | 270/58.08 X |
| 5,121,868 | 6/1992 | Jairam | 227/131 X |
| 5,279,494 | 1/1994 | Kitajima et al. | 270/58.14 |
| 5,338,017 | 8/1994 | Stemmle | 270/53 |

*Primary Examiner*—Hoang Nguyen
*Attorney, Agent, or Firm*—Tallam I. Nguti

[57] ABSTRACT

In a reproduction machine, a user clearable convenience stapler assembly. The convenience stapler assembly includes a stapling apparatus having a stapler head for stapling together a set of copy sheets, and a mounting assembly for mounting and supporting the stapling apparatus to a portion of a frame of the reproduction machine. The stapling apparatus is mounted and supported such that staple jams within the stapler head are clearable by an ordinary user of the reproduction machine. The mounting assembly includes a pivot plate sub-assembly for mounting to the stapling apparatus, and a support sub-assembly for supporting the pivot plate sub-assembly and the stapling apparatus in a stapling position and in a jam clearing position. The pivot plate sub-assembly has integrally formed therein hinge tabs for forming part of a pivot assembly for the stapling apparatus and pivot plate sub-assembly, and a latching aperture for receiving a latching stop member from the support sub-assembly. The support sub-assembly has integrally formed therein tab claw arrangements for receiving and pivotably retaining the hinge tabs of the pivot plate sub-assembly, a latching stop member for latching the pivot plate sub-assembly through the latching aperture, and spring members for retaining the pivot plate sub-assembly and the stapling apparatus in the stapling position and jam clearing position, thus allowing an ordinary user of the reproduction machine to safely and easily pivot the stapling apparatus and pivot plate sub-assembly into the jam clearing position.

10 Claims, 4 Drawing Sheets

REPRODUCTION MACHINE HAVING A USER CLEARABLE CONVENIENCE STAPLER ASSEMBLY

BACKGROUND OF THE INVENTION

This invention relates to electrostatographic reproduction machines, and, more particularly, to such a machine having a machine user clearable stapler assembly including a convenience stapler.

Generally, the process of electrostatographic reproduction includes uniformly charging an image frame of a moving photoconductive member, or photoreceptor, to a substantially uniform potential, and imagewise discharging it or imagewise exposing it to light reflected from an original image being reproduced. The result is an electrostatically formed latent image on the image frame of the photoconductive member. For multiple original images, several such frames are similarly imaged. The latent image so formed on each frame is developed by bringing a charged developer material into contact therewith. Two-component and single-component developer materials are commonly used. A typical two-component developer material comprises magnetic carrier particles, also known as "carrier beads," having fusable charged toner particles adhering triboelectrically thereto. A single component developer material typically comprises charged toner particles only. In either case, the fusable charged toner particles when brought into contact with each latent image, are attracted to such image, thus forming a toner image on the photoconductive member. The toner image is subsequently transferred to an image receiver copy sheet which is then passed through a fuser apparatus where the toner image is heated and permanently fused to the copy sheet forming a hard copy of each of the original images.

As disclosed for example in U.S. Pat. No. 5,338,017 it is known to provide an electrostatographic reproduction machine of the above type, for example, with sorting and finishing apparatus for arranging copy sheets fused as above into sets, and for binding or stapling together the sheets in each such set. As further disclosed, for example, in U.S. Pat. No. 5,094,379, such stapling together can be achieved by using a convenience stapler, or stapling apparatus assembly that is partially built into the frame of the machine for the user's or customer's convenience. To use a convenience stapling apparatus assembly as such, a user or customer must manually pick up and align a set of copy sheets to be stapled, and insert the set of sheets through an available slot into the stapler or stapling head of the stapling apparatus assembly. When properly inserted, the set of sheets will be stapled in the same manner as on a stand-alone powered stapling device.

As it is the case with all such stapling devices, staple jams do occur within the stapling head of such a convenience stapling apparatus. Current designs, of both the convenience stapler or stapling apparatus, and of its mounting members within a portion of the machine frame, do not allow the user to clear staple jams. Ordinarily, because the convenience stapler or stapling apparatus assembly is partially built into the frame of the reproduction machine, a staple jam in the stapling head of the stapling apparatus typically is not customer clearable, and instead requires the services of a skilled field service technician to clear. The undesirable results are usually stapling apparatus downtime while waiting for such a technician, and customer dissatisfaction.

There has therefore been a need for a safe and economical convenience stapling apparatus assembly that is customer clearable, thus avoiding the above undesirable results.

SUMMARY OF THE INVENTION

In accordance with one aspect of the present invention, there is provided in a reproduction machine, a user clearable convenience stapler assembly. The convenience stapler assembly includes a stapling apparatus having a stapler head for stapling together a set of copy sheets, and a mounting assembly for mounting and supporting the stapling apparatus to a portion of a frame of the reproduction machine. The stapling apparatus is mounted and supported with the portion of the frame such that staple jams within the stapler head are clearable by an ordinary user of the reproduction machine. The mounting assembly includes a pivot plate sub-assembly for mounting to the stapling apparatus, and a support sub-assembly for supporting the pivot plate sub-assembly and the stapling apparatus in a stapling position as well as in a jam clearing position. The pivot plate sub-assembly has integrally formed therein hinge tabs for forming part of a pivot assembly for the stapling apparatus and pivot plate sub-assembly, and a latching aperture for receiving a latching stop member from the support sub-assembly. The support sub-assembly has integrally formed therein arrangements of tab claws for receiving and pivotably retaining the hinge tabs of the pivot plate sub-assembly, a latching stop member for latching the pivot plate sub-assembly through the latching aperture, and spring members for retaining the pivot plate sub-assembly and the stapling apparatus in the stapling position in the and jam clearing position, thus allowing an ordinary user of the reproduction machine to safely and easily pivot the stapling apparatus and pivot plate sub-assembly into the jam clearing position.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
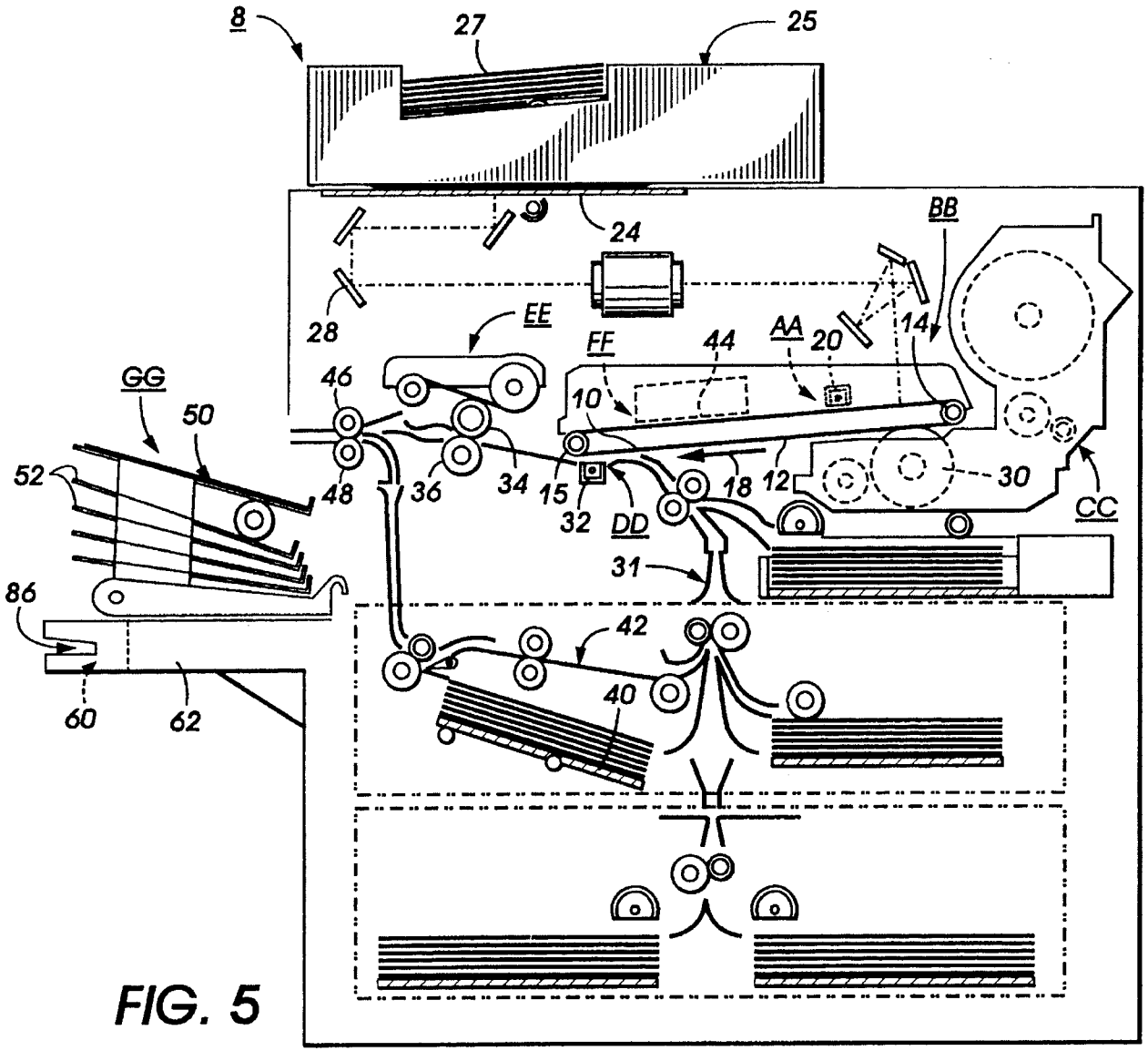
FIG. 5 is a vertical schematic of an exemplary electrostatographic reproduction machine including the user clearable convenience stapler assembly in accordance with the present invention.

Referring first to FIG. 5, an exemplary electrostatographic reproduction machine 8 according to the present invention is illustrated. As shown, the machine 8 has conventional imaging processing stations associated therewith, including a charging station AA, an imaging/exposing station BB, a development station CC, a transfer station DD, a fusing station EE, and a cleaning station FF. Importantly, the machine includes a finishing station shown generally as GG, that has the user clearable stapler assembly of the present invention (to be described in detail below).

As shown, the machine 8 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 8 can be briefly described as follows. Initially, the photoconductive belt 10 is charged at the charging station AA by a corona generating device 20. The charged portion of the belt is then transported by action of the drive roller 14 to the imaging/exposing station BB where a latent image is formed on the belt 10 corresponding to the image on a document positioned on a platen 24 via the light lens imaging system 28 of the imaging/exposing station BB. It will also be understood that the light lens imaging system can easily be changed to an input/output scanning terminal or an output scanning terminal driven by a data input signal to likewise image the belt 10. As is also well known, the document on the platen 24 can be placed there manually, or it can be fed there automatically by an automatic document handler device 25 that includes a multiple document sheet holding tray 27.

The portion of the belt 10 bearing the latent image is then transported to the development station CC where the latent image is developed by electrically charged toner material from a magnetic developer roller 30 of the developer station CC. The developed image on the belt is then transported to the transfer station DD where the toner image is transferred to a copy sheet fed by a copy sheet handling system 31. In this case, a corona generating device 32 is provided for charging the copy sheet so as to attract the charged toner image from the photoconductive belt 10 to the copy sheet. The copy sheet with the transferred image thereon is then directed to the fuser station EE. The fuser apparatus at station EE includes a heated fuser roll 34 and backup pressure roll 36. The heated fuser roll 34 and pressure roll 36 rotatably cooperate to fuse and fix the toner image onto the copy sheet. The copy sheet then, as is well known, may be selectively transported to the finishing area GG, or to a duplex tray 40 along a selectable duplex path 42 for duplexing.

The portion of the belt 10 from which the developed image was transferred is then advanced to the cleaning station FF where residual toner and charge on the belt are removed by a cleaning device such as a blade 44, and a discharge lamp (not shown) in order to prepare the portion for a subsequent imaging cycle.

When not doing duplex imaging, or at the end of such duplex imaging, the copy sheets upon finally leaving the fusing rolls 34, 36, are passed to finishing area input rolls 46 and 48. From the input rolls 46, 48, the copy sheets are fed, for example, individually to an output tray (not shown) or to a bin sorter apparatus 50 where the sheets can be arranged in a collated unstapled set within the tray or within each bin 52 of the bin sorter apparatus. The bin sorter apparatus 50 can comprise any number of bins 52, which as are well known, can be designed to nest, as well as to indexably cycle past a fixed loading point for sheets. A machine user making such set of copy sheets on the reproduction machine 8 can thus manually remove each such set at a time, and insert a corner or edge of the set into the convenience stapler assembly 60 of the present invention, for convenient stapling. As shown, the convenient stapler assembly 60 is built into a portion 62 of the frame of the machine 8, and at a location conveniently close to the bin sorter apparatus or output tray.

Figure 1:
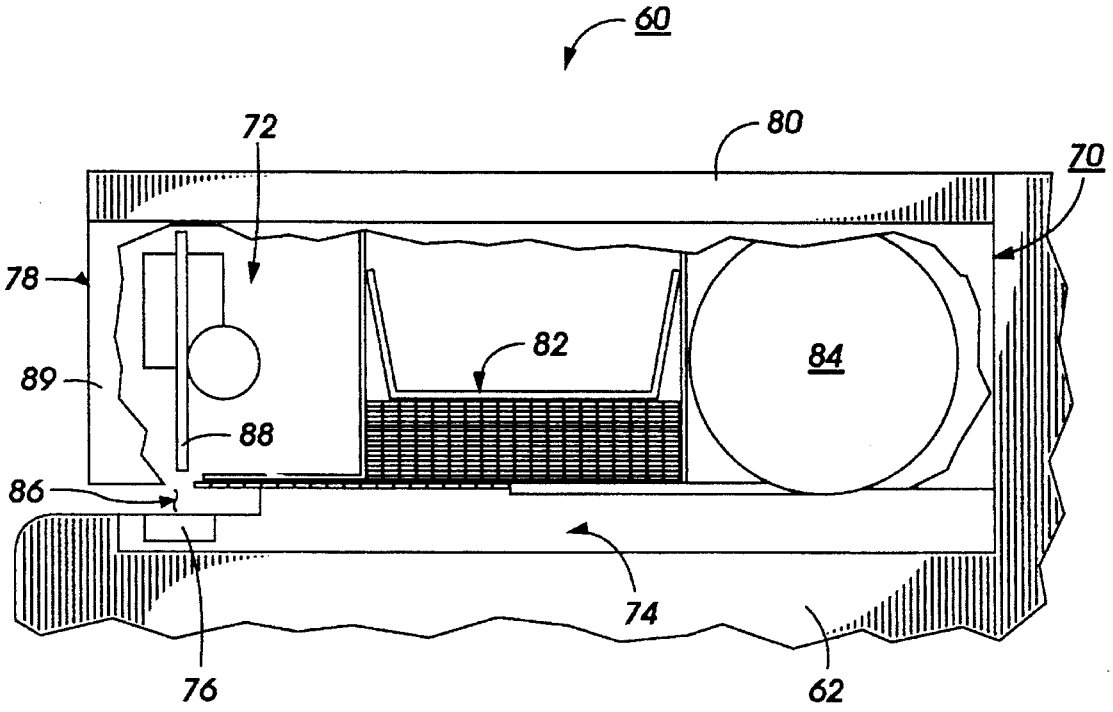
FIG. 1 is a schematic vertical side view of the convenience stapler assembly of the present invention.

Referring now to FIG. 1 the user clearable convenience stapler assembly 60 as mounted within a portion 62 of the reproduction machine 8 is illustrated. The assembly 60, as shown, includes a stapling apparatus 70 that has a stapler head 72 for stapling together a set of copy sheets. The stapling apparatus 70 includes a base portion 74 that has a clincher plate 76 for clinching the legs of a staple. The stapling apparatus 60 also includes a top or main body portion 78. As shown, the top portion 78 includes a pivotable cover 80, a magazine area for receiving and holding a cartridge 82 of staples and a powered drive assembly 84 for feeding staples one at a time to the stapler head 72. The stapler head includes a slot 86 that lies above, and orthogonally relative to the clincher plate 76 for receiving an edge or a corner of a set of copy sheets for stapling. Across the slot 86 from the clincher plate 76, the stapler head includes a staple forming and driving unit 88 for forming and driving the legs of a staple through a set of sheets within the slot, and against the clincher plate. As shown, the clincher plate and staple forming and driving unit are recessed from the face 89 of the stapler head. Unfortunately, when staple jams occur within the stapler head, they occur within this recessed area. In conventionally mounted convenience stapler assemblies, clearing such a staple jam ordinarily would require the skilled and special services of a technician.

Figure 2:
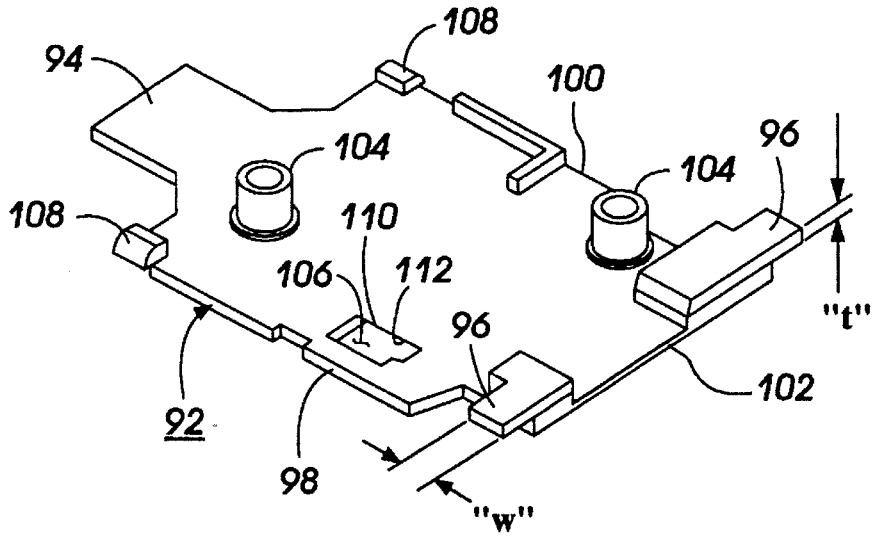
FIG. 2 is a perspective illustration of the pivot plate sub-assembly of the mounting assembly of the present invention.
Figure 3:
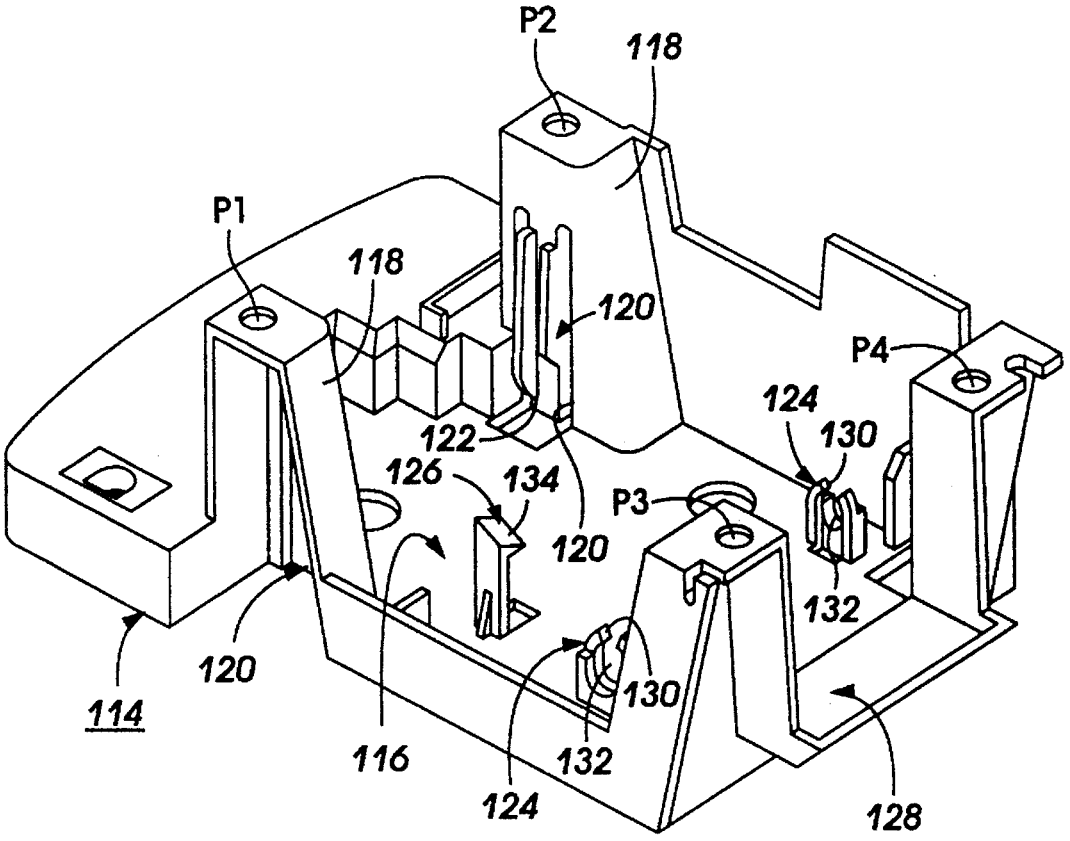
FIG. 3 is a perspective illustration of the support sub-assembly of the mounting assembly of the present invention.
Figure 4:
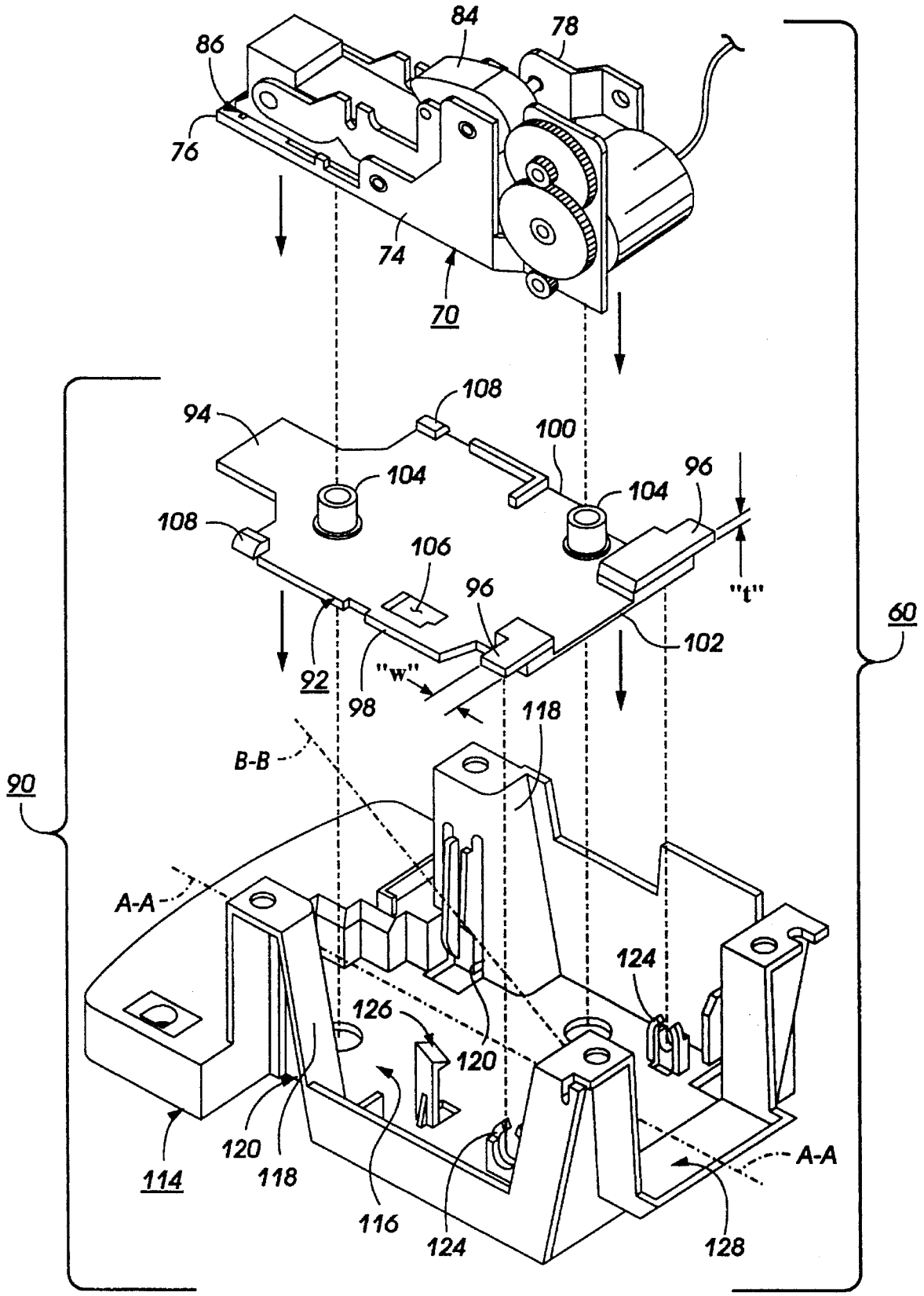
FIG. 4 is an exploded view illustration of the mounting assembly and the stapling apparatus of the present invention.

Referring now to FIGS. 2 to 4, the convenience stapler assembly 60 of the present invention also includes a mounting assembly 90 for mounting and supporting the stapling apparatus 70 to the portion 62 of a frame of the reproduction machine 8, such that staple jams within the stapler head 72 are clearable by an ordinary unskilled user of the reproduction machine 8. The mounting assembly 90 includes as shown in FIG. 2, a pivot plate sub-assembly 92 for mounting to the base portion 74 of the stapling apparatus 70. According to the present invention, the pivot plate sub-assembly 92 has a front end 94, and a pair of hinge tabs 96 integrally formed, one to either side edge 98, 100 towards a rear end 102 thereof, for forming part of a pivot assembly. The pivot plate sub-assembly also includes a pair of mounting stub members 104, each with a hole through it for mounting the stapling apparatus 70 therethrough by using a screw, for example. Additionally, the pivot plate sub-assembly 92 also includes at least one latching aperture 106 for receiving a latching stop member. The pivot plate sub-assembly 92 further has a pair of radiused contact members 108 also integrally formed one on either side edge 98, 100, respectively. As further illustrated, each of the hinge tabs 96 projects sideways beyond the respective side edges 98, 100, and is generally flat. Each has a width dimension "w", and a thickness dimension "t" that is less than the width dimension "w". Importantly, the latching aperture 106 includes at least one side 110 that has a bottom beveled edge 112 for ease of assembly onto a latching stop member.

The mounting assembly 90 also includes a support sub-assembly 114 as shown in FIG. 3, for supporting the pivot plate sub-assembly 92 and the stapling apparatus 70 (mounted together with a screw through each of the stub members 104 as above). As shown in FIG. 4, the pivot plate subassembly and stapling apparatus mounted as such can be supported in a stapling position indicated by the line A—A, and after pivoting, in a jam clearing position indicated by the line B—B. The support sub-assembly 114 has a recessed surface 116 for supporting the stapling apparatus and pivot plate sub-assembly in the stapling position A—A, and integrally formed perpendicularly extending members 118 containing a pair of spring members 120. Each of the spring members 120 is cantilevered from an extending member 118, and has an attached end and a free end 122. The free end 122 of each spring member is advantageously thicker than the attached end thereof for providing frictional retaining contact with a radiused contact member 108 of the pivot plate sub-assembly. The support sub-assembly 114 also has a pair of tab claw arrangements 124 integrally formed within the recessed surface 116 for receiving and pivotably retaining the hinge tabs 96 of the pivot plate sub-assembly, as well as a latching stop member 126 for receiving and latching the pivot plate sub-assembly (with the stapling apparatus mounted thereto) through the latching aperture 106. The tab claw arrangements 124 are formed towards a rear end 128 of the support sub-assembly, and each includes a hinge tab insertion gap 130, and a generally circular bore 132 (FIG. 3) for retaining a hinge tab 96 rotatably. Four holes shown for example at P1, P2, P3, and P4 are provided one on a vertically extending member for mounting the support sub-assembly 114 fixedly to the portion 62 of the machine frame.

The convenience stapler or stapling apparatus assembly 60 of the present invention advantageously allows the customer or machine user to easily clear staple jams when such jams occur, thus keeping the stapler assembly in use, as well as increasing the user's productivity. As will become clear from the installation directions below, the time required for assemblying/disassemblying the new mounting assembly 90 has been greatly reduced, thereby reducing both manufacturing assembly time, and technician's service/replacement time.

Initially, the stapling apparatus 70 is mounted with screws through the mounting stub members 104 of the pivot plate sub-assembly to the pivot plate sub-assembly 92. The pivot plate sub-assembly (with the stapling apparatus mounted thereto) is then installed onto the support sub-assembly 114. To do so, the pivot plate sub-assembly is held in a substantially vertical orientation so that the thickness dimension "t" of each hinge tab 96 is insertable through an insertion gap 130 into the bore 132 of a tab claw arrangement 124. With the hinge tabs within the bores 132, the pivot plate sub-assembly (with the stapling apparatus mounted thereto) can then be rotated, for example, counterclockwise as viewed in FIG. 4, until a beveled top hook portion 134 of the latching stop member 126 passes completely through the latching aperture 106 of the pivot plate sub-assembly. The bottom side of the edge 112 of the latching aperture 106 that contacts the top of the hook portion 134 of the latching stop member is beveled at an angle of about 45° in order to ensure ease of installation onto the latching stop member 126. Essentially, the pivot plate sub-assembly (with the stapling apparatus mounted thereto) is then within the jam clearing or raised position B—B, with the radiused contacting member 108 on each edge of the pivot plate sub-assembly in contact with its corresponding cantilevered spring member 120. It is in this position that the stapler head 72 is exposed from the surrounding machine frame portion. The pivot plate sub-assembly 92 (with the stapling apparatus mounted thereto) is held or retained in the raised or jam clearing position B—B by the latching stop member 126 and by contact between the radiused contact members 108 and spring members 120. The hook portion 134 of the latching stop member 126 prevents the pivot plate sub-assembly from rotating back clockwise or upwardly, and the spring members in contact with the radiused contact members 108, act to hold the pivot plate sub-assembly in the up, or jam clearing position.

The pivot plate sub-assembly 92 (with the stapling apparatus mounted thereto) can then be rotated further towards the stapling position A—A until it is snapped into, and secured to, the recessed surface 116 of the support sub-assembly 114. The thicker lower free end 122 of each spring member 120 is radiused out. This is so that when the pivot plate sub-assembly 92 (with the stapling apparatus mounted thereto) is rotated down towards the recessed surface 116, it "snaps" into and is retained in the operating position A—A. The "snap" accomplished there, is very positive, and is an excellent indicator to the user or customer that the stapler assembly 60 is all the way down, and ready for operation.

In order to clear a staple jam that occurs within the stapler head 72, an unskilled, ordinary user of the machine 8 will open the pivotable access lid or cover 80 to expose the top portion 78 including the stapler head 72 of the stapling apparatus 70. The user can by relying on colored (e.g. green) marked portions of the stapling apparatus (as is conventional for operator or user service guides), grasp the stapler head 72 from the sides, and raise it until the pivot plate sub-assembly 92 (with the stapling apparatus mounted thereto) reaches and is held as above in the jam clearing position B—B. Additional green marked portions such as the face plate 89 of the stapler head, will guide the user through the rest of the steps to be followed to clear the staple jam. Such steps eventually include fully lifting and pushing back the staple former/driving unit 88. A "sweeping" action of the staple former/driving unit during the pushing back step dislodges any jammed staple within the stapler head 72 within view of the user. Once the jam has been cleared as such, the steps can then be reversed including rotating the pivot plate sub-assembly 92 (with the stapling apparatus mounted thereto) counter clockwise from the jam clearing position B—B back into the operational or stapling position A—A, ready for stapling.

In further accordance with the present invention, each of the pivot plate sub-assembly 92 and the support sub-assembly 114 is preferably molded integrally from a plastic material such as acrylonitrile butadiene styrene (abbrev. ABS) which is an excellent impact resistant molding plastic.

As can be seen, the new stapler assembly design of the present invention provides easy user or customer access to the staple forming/driving area of the stapler head for clearing staple jams. The assembly do so by including a mounting package that allows the customer to pivot the front of the stapler head upward to clear surrounding mounting/esthetic components of the assembly. This can be accomplished by an unskilled user without tools, and thus serves to keep the stapler assembly in operation, avoiding downtime and customer dissatisfaction.

It is, therefore, apparent that there has been provided in accordance with the present invention, a user clearable convenience stapler assembly that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. In a reproduction machine, a user clearable convenience stapler assembly comprising:

(a) a stapling apparatus including a stapler head for stapling together a set of copy sheets; and (b) a mounting assembly for mounting and supporting said stapling apparatus to a portion of a frame of the reproduction machine such that staple jams within the stapler head are clearable by an ordinary user of the reproduction machine, the mounting assembly including:

(i) a pivot plate sub-assembly for mounting to said stapling apparatus, said pivot plate sub-assembly having integrally formed therein hinge tabs for forming part of a pivot assembly, and a latching aperture for receiving a latching stop member; and (ii) a support sub-assembly for supporting said pivot plate sub-assembly and said stapling apparatus in a stapling position and in a jam clearing position, said support sub-assembly having integrally formed therein, tab claw arrangements for receiving and pivotably retaining said hinge tabs of said pivot plate sub assembly, a latching stop member for latching said pivot plate sub-assembly through said latching aperture, and spring members for retaining said pivot plate sub-assembly and said stapling apparatus, in the stapling position and in the jam clearing position.

2. The user clearable convenience stapler assembly of claim 1, wherein said pivot plate sub-assembly further has a pair of radiused contact members formed one on either side edge of said pivot plate sub-assembly for frictionally contacting said spring members of said support sub-assembly.

3. The user clearable convenience stapler assembly of claim 1, wherein each said hinge tab is generally flat and has a width dimension, and a thickness dimension less than said width dimension for orientational insertion and retention within said tab claw arrangements.

4. The user clearable convenience stapler assembly of claim 1, wherein said latching aperture has a bottom beveled edge for ease of sliding assembly onto said latching stop member.

5. The user clearable convenience stapler assembly of claim 1, wherein said support sub-assembly further includes a recessed surface for supporting said stapling apparatus and said pivot plate sub-assembly in the stapling position, and includes perpendicularly extending members containing said spring members.

6. The user clearable convenience stapler assembly of claim 1, wherein said tab claw arrangements are formed towards a rear end of said support sub-assembly and each includes a hinge tab insertion gap and a generally circular bore for retaining a hinge tab rotatably.

7. The user clearable convenience stapler assembly of claim 1, wherein each said spring member is cantilevered and has an attached end and a free end, said free end being thicker than said attached end, for providing retaining contact with said pivot plate sub-assembly, between the jam clearing position and the stapling position.

8. The user clearable convenience stapler assembly of claim 4, wherein said bottom beveled edge of said latching aperture includes a 45° bevel.

9. The user clearable convenience stapler assembly of claim 5, wherein said pivot plate sub-assembly and said support sub-assembly are each molded integrally out of acrylonitrile butadiene styrene material.

10. A reproduction machine comprising:

(a) a frame;

(b) means mounted within said frame for forming reproductions of original images onto copy sheets of paper;

(c) means for collecting a plurality of the copy sheets into a set of such sheets; and (d) a user clearable convenience stapler assembly built into a portion of said frame for receiving and stapling a manually presented set of copy sheets, said stapler assembly including:

(i) a stapling apparatus having a stapler head for stapling together a set of the copy sheets; and (ii) a mounting assembly comprising (a) a pivot plate sub-assembly for mounting to said stapling apparatus, said pivot plate sub-assembly having integrally formed hinge tabs for forming part of a pivot assembly, and a latching aperture for receiving a latching stop member; and (b) a support sub-assembly for supporting said pivot plate sub-assembly in a stapling position and in a jam clearing position, said support sub-assembly having integrally formed therein, tab claw arrangements for receiving and pivotably retaining said hinge tabs of said pivot plate sub-assembly, a latching stop member for latching said pivot plate sub-assembly through said latching aperture, and spring members for retaining said pivot plate sub-assembly in the stapling position and in the jam clearing position.

* * * * *